United States Patent [19]

Simon et al.

[11] 4,358,351

[45] Nov. 9, 1982

[54] ALKALINE BATH FOR THE ELECTROLYTIC DEPOSITION OF LOW CARAT YELLOW COLORED GOLD ALLOY LAYERS

[75] Inventors: Franz Simon, Schwäbisch Gmünd; Werner Huth, Grosskrotzenburg; Bernd Dorbath; Wolfgang Zilske, both of Hanau, all of Fed. Rep. of Germany

[73] Assignee: Degussa Aktiengesellschaft, Frankfurt, Fed. Rep. of Germany

[21] Appl. No.: 266,148

[22] Filed: May 22, 1981

[30] Foreign Application Priority Data

May 31, 1980 [DE] Fed. Rep. of Germany ..... 3020765

[51] Int. Cl.[3] ..... C25D 3/62

[52] U.S. Cl. ..... 204/44

[58] Field of Search ..... 204/44, 123

[56] References Cited

U.S. PATENT DOCUMENTS

| | | | |
|---|---|---|---|
| 2,724,687 | 11/1955 | Spreter et al. | 204/44 X |
| 3,749,650 | 7/1973 | Dettke et al. | 204/44 |
| 3,883,409 | 5/1975 | Olivier | 204/44 |

FOREIGN PATENT DOCUMENTS

| | | | |
|---|---|---|---|
| 1033987 | 7/1958 | Fed. Rep. of Germany | 204/44 |
| 2221159 | 10/1973 | Fed. Rep. of Germany | 204/44 |
| 2244434 | 3/1974 | Fed. Rep. of Germany | 204/43 G |
| 2342691 | 3/1974 | Fed. Rep. of Germany | 204/43 G |
| 2754207 | 3/1979 | Fed. Rep. of Germany | 204/43 G |
| 45-2085 | 1/1970 | Japan | 204/44 |
| 56-62984 | 5/1981 | Japan | 204/44 |

*Primary Examiner*—G. L. Kaplan

*Attorney, Agent, or Firm*—Cushman, Darby & Cushman

[57] ABSTRACT

For the production of low carat rose to gold colored gold alloy coatings there are needed electrolytic baths containing soluble gold cyanide, soluble copper cyanide, potassium carbonate or potassium bicarbonate which produce corrosion resistant coatings of 13–18 carats and no physiologically hazardous cadmium. The baths of the present invention contain, in place of cadmium, 7.5 to 40 grams/liter of zinc as complex zinc cyanide.

21 Claims, No Drawings

ALKALINE BATH FOR THE ELECTROLYTIC DEPOSITION OF LOW CARAT YELLOW COLORED GOLD ALLOY LAYERS

BACKGROUND OF THE INVENTION

The invention is directed to an alkaline bath for the electrolytic deposition of low carat rose to yellow colored gold alloy coatings containing soluble gold cyanide, soluble copper cyanide, and potassium carbonate or potassium bicarbonate. Thereby there are deposited corrosion resistant coatings in the range of 13 to 18 carats.

For the production of low carat rose and yellow colored gold alloy coatings there have previously been used baths which contain besides complex gold and copper cyanides, cadmium and chelate formers (German OS 2221159, the entire disclosure of which is hereby incorporated by reference and relied upon). Such baths generally operate in a pH range of 7.5 to 12 and contain besides cyanide, conductive salts such as carbonates and buffer salts such as e.g., phosphates. They produce, with favorable operating conditions, glossy rose colored or yellow alloy precipitates of good quality. However, these baths have the serious disadvantage that they contain cadmium which is physiologically hazardous and must be replaced by other materials.

There are also known gold baths which contain, as soluble salts, besides gold also zinc and other alloying metals, especially copper. However, until now with such electrolytic baths, there have been produced no rose colored or yellow low carat gold alloy coatings, but only high carat or discolored coatings.

In German OS 2342691 there is described an alkaline cyanidic white gold bath which, besides potassium gold cyanide and potassium zinc cyanide, contains potassium nickel cyanide and dipotassium hydrogen phosphate at a pH of 9–13. However, with these baths there cannot be produced low carat gold alloy coatings.

There is known from German OS 2244434 an electrolytic gold alloy bath which besides potassium gold cyanide, also contains copper sulfate and, in a given case, a zinc salt. However, there are not obtained from these baths which operate at a pH of 3–10 and contain aldehyde, diamine and arsenious acid as essential components any low carat gold alloy layers.

In German OS 2754207 there is described a gold alloy bath which contains potassium gold cyanide, zinc sulfate and sodium carbonate and is operated at a pH of 4.9. There are deposited from this bath green precipitates.

Furthermore, there is known (German AS 1033987) a gold alloy bath which contains potassium gold cyanide, copper, zinc and nickel in the form of their ethylenediamine tetraacetic acid salts. There are obtained at a pH of 8 and a temperature of 60° C. 19 carat alloy coatings which are greyish.

With none of the electrolytic gold alloy baths mentioned here based on gold, copper, zinc, was it possible until now to produce low carat rose to yellow colored coatings.

Therefore, it was the problem of the present invention to develop an alkaline bath for the electrolytic deposition of low carat rose to gold colored gold alloy coatings containing soluble gold cyanide, soluble copper cyanide, and potassium carbonate or potassium bicarbonate which produce corrosion resistant, physiologically safe 13–18 carat coatings.

SUMMARY OF THE INVENTION

This problem was solved according to the invention by including in the bath 7.5–40 g/l of zinc as a complex cyanide.

There have proven good baths of this type which contain 3–10 g/l of gold as alkali gold cyanide (e.g. potassium gold cyanide or sodium gold cyanide), 5–35 g/l of copper as alkali copper cyanide (e.g. potassium copper cyanide or sodium copper cyanide) and 2.5–20 g/l of potassium carbonate and/or potassium hydrogen carbonate. Preferably such baths contain 10–30 g/l of zinc as $K_2(Zn(CN_4)$.

For the production of rose colored gold alloy coatings there are advantageously employed baths which have added thereto 5–25 g/l of an alkali salt of a phosphoric and/or phosphonic acid, for the production of yellow gold alloy coatings 0.5–5 g/l of ammonia and/or an amine.

Examples of suitable phosphates and phosphonates are found in German OS 2221159 and Olivier U.S. Pat. No. 3,883,409 and include for example, sodium phosphate, potassium phosphate, disodium hydrogen phosphate, dipotassium hydrogen phosphate, sodium and potassium salts of 1-hydroxyethane-1,1-diphosphonic acid, sodium and potassium salts of hydroxymethane diphosphonic acid, sodium and potassium salts of 1-hydroxybutylidene diphosphonic acid. The entire disclosure of the Olivier U.S. patent is hereby incorporated by reference and relied upon.

Amines include for example triethyl amine, trimethyl amine, tributyl amine, ethylene diamine, diethylene triamine, triethylenetetraamine, tetraethylenepentamine.

There have also proven good baths which contain 0.2–1.5 g/l of a selenium and/or arsenic compound as gloss additive. Examples of such compounds include selenious acid, sodium selenite, potassium selenite, arsenious acid, sodium arsenite, sodium arsenate, potassium arsenite, potassium arsenate. The addition of chelate formers (chelating agents) such as ethylenediamine tetraacetic acid or other aminocarboxylic acids in an amount of 5–20/gl is likewise recommended in many cases. Such chelating agents include for example nitrilotriacetic acid and its sodium and potassium salts, ethylenediaminetetraacetic acid and its sodium and potassium salts, 1,2-diaminocyclohexanetetraacetic acid and its sodium and potassium salts, bis-2-aminoethylethertetraacetic acid and its sodium and potassium salts, diethylenetriaminopentaacetic acid and its sodium and potassium salts, 1-hydroxyethane-1,1-diphosphonic acid and its sodium and potassium salts, amonotrimethylenephosphonic acid and its sodium and potassium salts, ethylenediaminetetramethylphosphonic acid and its sodium and potassium salts, hexamethylenediamino tetra-(methyl phosphonic acid) and its sodium and potassium salts, and also the other chelating agents mentioned in Olivier U.S. Pat. No. 3,883,409.

There has proven good as operating temperature the range of 50° to 75° C., especially 60°–75° C. and as pH the range of 8–12, especially 9–10.

The baths of the invention make it possible to produce a constant, uniform rose coloration or yellow coloration in spite of different carat content of 13–18 carat coatings according to the composition of the bath and operating conditions. Even at a fineness of 14 kt there is produced a pleasant rose tint (3–4 N) at copper contents of 30 to 40 weight %, which is surprising at these high copper contents. Even at strongly varying gold content, in the bath between 3 and 10 g/l and a zinc content between 2 and 15% in the coating there is produced a nearly constant rose tint. The deposited coatings exhibit a good ductility.

It is surprising that by the codeposition of zinc from the electrolytic cyanidic gold-copper baths there can be produced a rose tint or also a yellow tint, since it is commonly known that the codeposition of zinc in larger amounts from gold-copper baths leads to discoloration, greyish and extremely brittle coatings, in contrast to cadmium.

The composition can comprise, consist essentially of or consist of the stated materials.

Unless otherwise indicated all parts and percentages are by weight.

The following examples further explain the advantages of the baths of the invention.

DETAILED DESCRIPTION

Example 1

There was deposited from a bath containing 8 g/l of gold as $K(Au(CN)_2)$, 30 g/l of copper as $K_3(Cu(CN)_4)$, 40 g/l of zinc as $K_2(Zn(CN)_4)$, 5 g/l of $K_2CO_3$, 0.3 g/l of $H_2SeO_3$, and 8 g/l of $K_2HPO_4$ at 60° C., a pH of 9 and current densities of 0.6–1 A/dm$^2$ rose colored Au/Cu/Zn coatings have a fineness of 13–15 kt.

Example 2

There was deposited from a bath having 5 g/l of gold as $K(Au(CN)_2)$, 7.5 g/l of copper as $K_3(Cu(CN_4)$, and 20 g/l of zinc as $K_2(Zn(CN)_4)$, which also contained 5 g/l of $K_2CO_3$, 0.3 g/l of $H_2SeO_3$ and 16 g/l of potassium tripolyphosphate at 65° C., pH of 9.5 and current densities between 1.2 and 1.8 A/dm$^2$, 18 carat rose colored coatings which contained about 5 weight % zinc.

Example 3

A bath containing 4 g/l of gold as $K(Au(CN)_2$, 7.5 g/l of copper as $K_3(Cu(CN)_4$, 15 g/l of zinc as $K_2(Zn(CN)_4)$, 10 g/l of $K_2CO_3$, 0.9 g/l of $H_2SeO_3$ and 5 g/l of 1-hydroxyethane-1,1-diphosphonic acid made possible at 75° C. and current densities between 1.0 and 1.3 A/dm$^2$ the deposition of 16 carat Au/Cu/Zn coatings having rose coloration.

Example 4

A bath containing 4 g/l of gold as $K(Au(CN)_2)$, 20 g/l of copper as $K_3(Cu(CN)_4)$, 20 g/l of Zn as $K_2(Zn(CN)_4,)$ 13 g/l of $K_2CO_3$, 18 g/l of $KHCO_3$ and 2 ml of 24% aqueous ammonia made possible at a pH of 10, a temperature of 60° C. and a current density of 0.8–1.2 A/dm$^2$, the deposition of 18 carat, yellow (2 N) gold alloy coating.

The rigidity and long time stability of the baths of the invention permit a disturbance free operation in practice since even varying metal contents lead to constant coatings at constant current densities.

The entire disclosure of German priority application P 3020765.9 is hereby incorporated by reference.

What is claimed is:

1. An aqueous alkaline bath suitable for electrolytically depositing low carat rose to gold colored gold alloy coatings comprising soluble gold cyanide, soluble copper cyanide, potassium carbonate or potassium bicarbonate and 7.5–40 g/l of zinc as a complex zinc cyanide.

2. An alkaline bath according to claim 1 containing 3–10 g/l of gold, 5–35 g/l of copper and 2.5–20 g/l of potassium carbonate, potassium bicarbonate or a mixture of potassium carbonate and potassium bicarbonate.

3. An alkaline bath according to claim 2 containing 10–30 g/l of zinc as $K_2(Zn(CN)_4)$.

4. An alkaline bath according to claim 3 containing 5–25 g/l of an alkali salt of a phosphoric acid or a phosphonic acid or mixtures thereof.

5. An alkaline bath according to claim 4 including 0.2–1.5 g/l of a selenium compound, an arsenic compound or a mixture thereof.

6. An alkaline bath according to claim 3 including 0.5–5 g/l of ammonia, an amine or a mixture of ammonia and an amine.

7. An alkaline bath according to claim 6 including 0.2–1.5 g/l of a selenium compound, an arsenic compound or a mixture thereof.

8. An alkaline bath according to claim 3 including 0.2–1.5 g/l of a selenium compound, an arsenic compound or a mixture thereof.

9. An alkaline bath according to claim 3 containing 5–20 g/l of a complex former.

10. An alkaline bath according to claim 3 having a pH of 8–12.

11. An alkaline bath according to claim 10 having a pH of 9–10.

12. A process of forming a 13–18 carat gold alloy on a substrate comprising electrodepositing at a pH of 8–12 gold alloy from the bath of claim 3.

13. An alkaline bath according to claim 2 containing 5–25 g/l of an alkali salt of a phosphoric acid or a phosphonic acid or mixtures thereof.

14. An alkaline bath according to claim 13 including 0.2–1.5 g/l of a selenium compound, an arsenic compound or a mixture thereof.

15. An alkaline bath according to claim 2 including 0.5–5 g/l of ammonia, an amine or a mixture of ammonia and an amine.

16. An alkaline bath according to claim 15 including 0.2–1.5 g/l of a selenium compound, an arsenic compound or a mixture thereof.

17. An alkaline bath according to claim 16 containing 5–20 g/l of a complex former.

18. An alkaline bath according to claim 2 including 0.2–1.5 g/l of a selenium compound, an arsenic compound or a mixture thereof.

19. An alkaline bath according to claim 2 containing 5–20 g/l of a complex former.

20. A process of forming a 13–18 carat gold alloy on a substrate comprising electrodepositing at a pH of 8–12 gold alloy from the bath of claim 2.

21. A process according to claim 20 wherein the temperature is 50°–75° C.

* * * * *